United States Patent [19]

Dixon

[11] 4,392,598

[45] Jul. 12, 1983

[54] CONVERTIBLE BACKPACK CHAIR

[76] Inventor: John F. Dixon, 425 California St., Suite 2600, San Francisco, Calif. 94104

[21] Appl. No.: 340,750

[22] Filed: Jan. 19, 1982

[51] Int. Cl.[3] ..... A45F 3/10

[52] U.S. Cl. ..... 224/155; 224/156; 224/159

[58] Field of Search ..... 224/153, 154, 155, 156, 224/210, 213, 159; 190/8, 12 A; 297/16, 35

[56] References Cited

U.S. PATENT DOCUMENTS 3,250,449 5/1966 Woodman ..... 224/155

*Primary Examiner*—Steven M. Pollard
*Assistant Examiner*—D. Voorhees
*Attorney, Agent, or Firm*—David W. Collins

[57] ABSTRACT

A convertible backpack chair, functioning alternately as a backpack and a collapsible chair is provided. Two parallel rigid side panels are employed to construct the backpack frame and provide a convenient volume for a pack bag.

The convertible backpack chair of the invention is lightweight, easily and efficiently convertible into a chair and back into a backpack, capable of standing without support in the pack or storage configuration and retains accessibility of the pack bag when in either configuration.

10 Claims, 3 Drawing Figures

CONVERTIBLE BACKPACK CHAIR

BACKGROUND OF THE INVENTION

1. Field of the Invention

This invention relates to a backpack which is readily usable for normal backpacking activities and which may also be easily and efficiently converted into a comfortable chair.

2. Description of the Prior Art

Backpacks which are suitable for recreational activities and, at the same time, are convertible into various types of camp furniture such as chairs, stools, cots or the like are known; see, e.g., U.S. Pat. Nos. 3,250,449, 3,266,686 and 4,286,739. Such convertible backpacks usually include a backpack frame supporting a pack bag, a pair of shoulder straps and often a waist strap for carrying the pack, and a collapsible piece of furniture, or portion thereof, attached to the frame.

For convertible backpacks, a number of specific features are desirable. First, the backpack should be lightweight for carrying. Second, the furniture components must be easily and efficiently collapsible and reconstructible. Third, to facilitate loading, unloading and storage in the pack configuration, the backpack should be capable of standing upright and alone, without support and without interference from the collapsed piece of furniture. Fourth, in the case of a convertible backpack chair, the pack bag should remain conveniently accessible in either the pack or chair configuration.

Such convertible backpacks as disclosed in the prior art, however, are not totally suitable for the functions of both backpacking and providing a chair for the user. For example, U.S. Pat. No. 3,250,449 discloses a convertible camping pack frame which can serve as a stool, chair, table or folding bed. However, the disclosed backpack chair frame will not stand unsupported in the pack configuration; neither is there any disclosure of a pack bag, nor a readily accessible location for such pack bag. U.S. Pat. No. 3,266,686 discloses a backpack chair which is not capable of standing unsupported for loading. Further, this invention is relatively cumbersome to assemble, requiring the user to erect the chair by swinging the chair back completely around, from one side of the pack to the other, and then to secure the chair back in position by means of chains. U.S. Pat. No. 4,286,739 discloses a convertible backpack chair/cot combination. This invention requires the detachment of the shoulder straps and the operation of a relatively complex mechanism to convert from pack to chair configuration. Further, the invention provides access to the contents of the pack bag only in the chair configuration, requires a separate structure to support the pack bag, and cannot stand unsupported in the pack configuration.

The prior art patents, then, do not offer all of the various desirable features of a convertible backpack chair. A need remains for a convertible backpack having all the desired features described above.

SUMMARY OF THE INVENTION

In accordance with the invention, a convertible backpack chair is provided, comprising (a) two parallel rigid side panels spaced apart, defining the two sides, and the top, bottom and end surfaces of a generally rectangular storage volume therebetween, (b) a pack bag comprising at least one compartment located within the volume and supported between the rigid side panels by support means, (c) a pair of shoulder straps for supporting the pack on the shoulders of a user, the straps being provided on the bottom surface, (d) a chair seat and (e) a collapsible chair portion provided on the top surface.

The rigid side panels are of generally rectangular shape. The side panels thus define a convenient right rectangular volume for the pack bag. The use of such side panels permits the unsupported resting of the backpack frame on level ground in either the chair or pack configuration. A resilient lumbar strap is provided on the same surface of the backpack as the shoulder straps.

The collapsible chair portion comprises (1) a generally U-shaped chair back frame, (2) a pair of arm rests, one end of each arm rest being pivotally attached to the chair back frame and the other end of each being pivotally attached to the rigid side panels, (3) a pair of hinge straps, one end of each being pivotally attached near the ends of the chair back frame and the other end of each being pivotally attached to the rigid side panels, and (4) a back support panel attached to the chair back frame. The seat portion comprises either one major surface of the pack bag or a separate piece of material supported by the backpack frame.

The convertible backpack chair of the invention retains all the desirable features of such apparatus. The invention is lightweight, easily and efficiently convertible from one configuration to the other, capable of standing alone in the pack configuration, and offers ready accessibility of the pack bag in either configuration. Other features and advantages of the convertible backpack chair will become evident upon an examination of the following detailed description of the invention and the accompanying drawings.

DETAILED DESCRIPTION OF THE INVENTION

Figure 1:
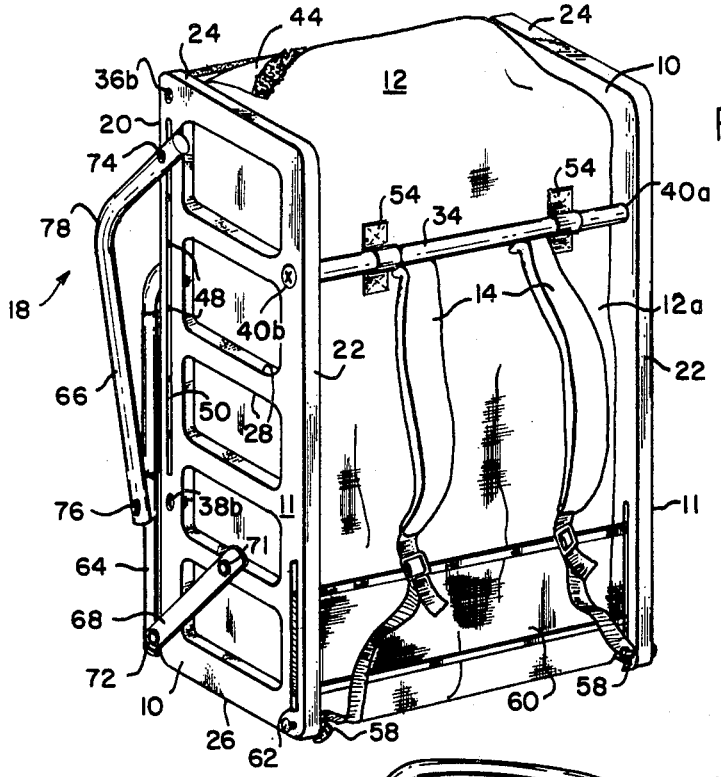
FIG. 1 depicts, in perspective, the convertible backpack chair of the invention in the pack (or storage) configuration as seen from the carrying side.
Figure 2:
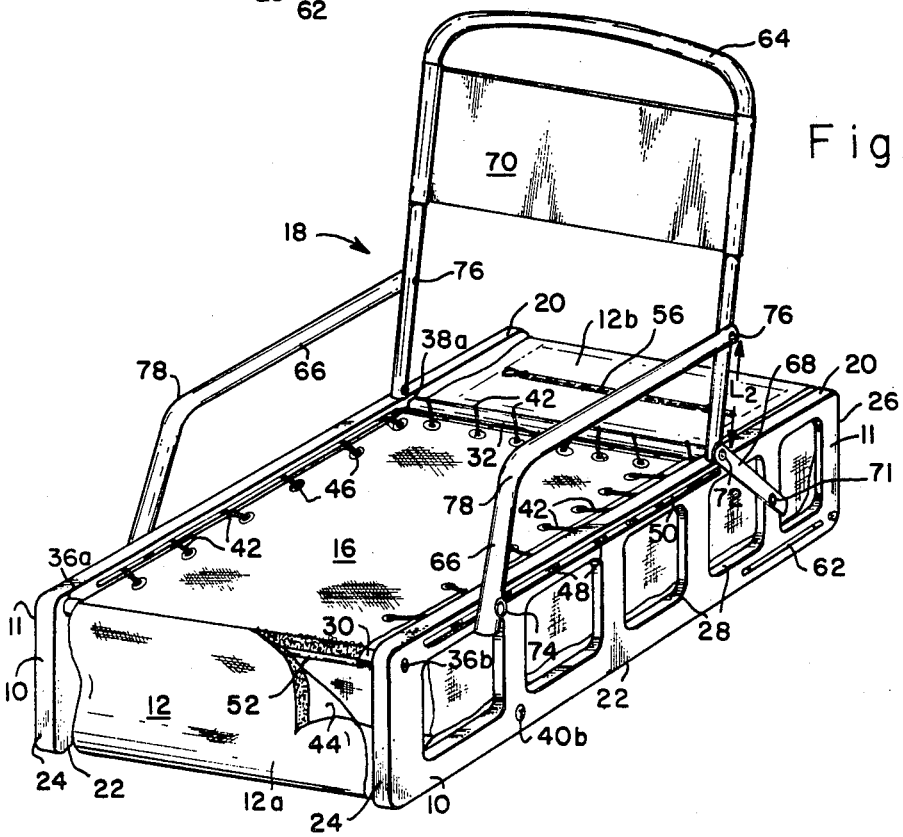
FIG. 2 depicts, in perspective, the convertible backpack chair of the invention in the chair configuration.

For the sake of convenience and reference, the convertible backpack chair of the invention will be described in terms of two configurations: the carrying or pack configuration (FIGS. 1 and 3) and the resting or chair configuration (FIG. 2). All directions, by convention, will be described in terms of the chair configuration. Thus, the top of the backpack refers to the chair side, while the bottom of the backpack refers to the side to which the shoulder straps are attached. Front and rear refer to the respective directions of a user sitting in the chair.

Figure 3:
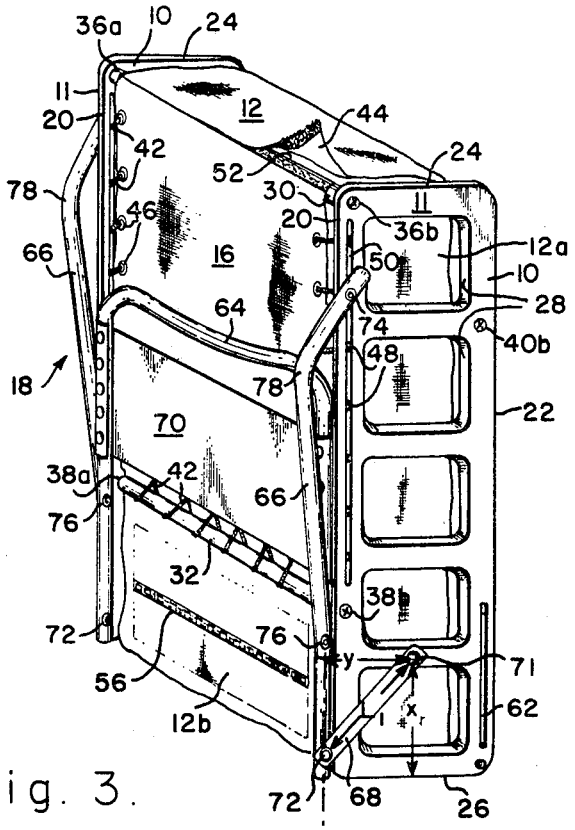
FIG. 3 depicts, in perspective, the convertible backpack chair of the invention in the pack configuration as seen from the chair side.

FIGS. 1-3 depict a convertible backpack chair comprising (a) a pair of parallel rigid side panels 10 spaced apart, (b) an accessible pack bag 12 supported between the rigid panels, (c) a pair of shoulder straps 14 for supporting the pack on the shoulders of a user, and (d) a chair seat 16 and (e) a collapsible chair portion 18.

The rigid panels 10 are of generally rectangular shape and define two sides 11, a top 20, bottom 22 and end surfaces 24, 26 of a generally rectangular storage volume contained therebetween. The rigid side panels are conveniently formed of a lightweight material having sufficient strength to support the various loads imposed during the intended use. The most significant of these loads are the forces of compression and tension imposed by the chair back hinge and arm rest attachments, and the lateral forces of tension caused by the weight of a person sitting in the chair.

The material comprising the rigid side panels should be impact resistant to protect against damage if dropped on a hard surface, relatively heat insensitive to avoid warping and deformation under high temperature conditions, and resistant to the ultraviolet (UV) radiation present in the outdoor environment. Suitable materials include wood, metal, a thermoplastic such as ABS or polycarbonate plastic, and a thermoset plastic such as polyurethane. Reduced weight can be achieved by limiting the maximum cross sectional thickness of the panels and by means of a number of cutouts 28. Panel strength is increased by means of a ribbed structure where added strength is required. For example, integral ribbing (not shown) may be provided between the two primary spacer bars 30 and 32 described below. Such ribs would be formed parallel to the top surface 20.

The side panels may be formed in many ways. For example, panels may be fabricated of lightweight tubing (e.g., aluminum) which is bent, welded or mechanically assembled with appropriate fittings. Alternately, the side panels may be constructed by extrusion of a lightweight metal or plastic material. The preferred embodiment, however, utilizes a high strength plastic, injection-molded to provide a rigid structure foam. This embodiment will meet the strength and weight requirements of the rigid side panels and provide an attractive appearance at a reasonable cost of production.

The rigid side panels are maintained apart by spacer bars 30, 32, 34. The spacer bars are conveniently tubular metallic members, such as aluminum, which may terminate in recesses 36*a*, 38*a*, 40*a* in the side panels to provide added frame rigidity. Each spacer bar may comprise a hollow tube and smaller diameter threaded rod inside the tube and coaxial therewith, extending to the outsides of the rigid side panels through appropriate-sized holes in the side panels. T-nuts, acorn nuts or other suitable fasteners may be used to tension the threaded rods, thereby securing the rigid side panels and spacer bars, as shown at 36*b*, 38*b*, 40*b*. Alternately, the spacer bars may be placed over cylindrical bosses (not shown) which could be integrally formed during the fabrication of the rigid side panels. In such a configuration, the spacer bars (at least the top two primary spacer bars 30, 32) would comprise hollow tubes, which would be press-fit over the bosses, with transverse tension provided by the trampoline-style lacing 42 of the chair seat 16 (described in further detail below). The bottom secondary spacer bar 34, since it does not directly carry the load of the seat tension, can be of smaller diameter than the primary bars.

The pack bag 12 comprises at least one compartment, and preferably two compartments 12*a* and 12*b*, and, as depicted in the Figures, is located and supported between the rigid panels by support means. The two compartments are referred to herein as the forward, or major, compartment 12*a* and the rear, or minor, compartment 12*b*. The major compartment comprises two side panels, a bottom, which is attached to the bottom spacer bar, and a top panel which, in the preferred embodiment, also comprises the chair seat 16. The bottom panel is extended to form a flap 44, which is used to close the forward compartment and is secured by suitable fastening means such as Velcro strips. Alternatively, other fasteners, such as straps or the like, may be used.

The seat panel 16 is laced in tension to the rigid side panels and to the rear primary spacer bar 32, employing grommets 46 installed in the seat panel. For this purpose, spaced apart holes 48 are appropriately provided in recesses 50 in the rigid side panels, thereby preventing damage to the laces 42 from chafing or rubbing encountered in normal use. At the forward edge of the seat panel, a loop tube 52 is formed through which the front primary spacer bar 30 is passed during assembly. The pack bag is conveniently fixed to the secondary spacer bar 34 by loops 54, comprising strapping or webbing, box-stitched to either side of the spacer bar. While the seat panel is described as integral to the pack bag, it should be understood that other configurations are also within the scope of this invention, such as the use of webbing or fabric for the seat portion, distinct and separate from the top panel of the pack bag.

The rear portion of the bag (the rear compartment, as shown) is held in place by a transverse support rod (not shown), the ends of which are inserted into recessed holes in the rigid side panels. The support rod conveniently passes through two grommets provided in the sides of the pack bag. The rear compartment, if employed, is provided with a suitable access 56, separate from the forward compartment. Zippered flaps (as shown), straps, buckles, Velcro fasteners or the like may be used.

It is clear that both compartments are readily accessible whether the backpack chair of the invention is in the pack configuration or the chair configuration and whether the backpack is standing in the upright orientation (FIGS. 1 & 3) or flat on the ground with the bottom side down. In the chair configuration (FIG. 2), the user can easily reach the contents of the main compartment through the front flap opening 44 even when sitting in the chair, and can also reach behind to access the contents of the rear compartment. In addition, both compartments are conveniently accessible by a helpful fellow backpacker while the pack remains on the shoulders of a user.

In the two-compartment embodiment of the backpack chair, either compartment, or both, can be provided with a simple insulating liner to facilitate the transport of chilled picnic supplies, drinks or the like. Such liner can be constructed, for example, of flexible polyurethane foam and may be fixed or removable.

The seat panel 16 comprises a tensioned stretch-resistant material such as chair duck canvas, acrylic fabric or woven Cordura fiber (E. I. DuPont de Nemours & Co., Wilmington, DE). The lacing 42 on three sides is of conventional stretch-resistent cord material and permits retightening from time to time to compensate for any permanent sag due to stretching which may result from normal use. The remainder of the pack bag is of conventional materials, typically pack nylon.

A pair of conventional shoulder straps 14, preferably adjustable, is provided on the bottom of the convertible backpack chair. One end of each strap is attached to the secondary spacer bar 34 by conventional means such as a sheet metal screw, clevis pin, or pop rivet. The other end of each strap is attached to the inside surface of the corresponding rigid side panel at the lower rear corner by similar conventional means 58, preferably clevis pins. This form of attachment permits resting or storing the backpack upright on the rear surface 26 or, alternately, flat on the bottom surface 22 without interference from the straps.

For comfort and ease in carrying, a lumbar strap 60 of resilient material is provided. The lumbar strap may be supported at either end, as shown here, by means of a slot 62 and a recessed support rod (not shown). The lumbar strap is threaded through the slot, around the support rod at each end and is tensioned by draw strings, as is conventional. Alternately, the support rod may be eliminated in favor of two closely spaced parallel slots. Other equivalent structures may also be employed, as long as the lumbar strap is supported in such a way as to avoid interference when the backpack is resting on the bottom surface 22.

On the top side of the convertible backpack (surface 20) is provided a chair seat 16 and a collapsible chair portion 18. The chair seat has been described above. The collapsible chair portion comprises (1) a generally U-shaped chair back frame 64, (2) a pair of arm rests 66, (3) a pair of hinge straps 68, and (4) a back support panel 70.

The top of the chair back frame 64 may be slightly bent away from a user sitting in the chair, as depicted here, for additional comfort. The back support panel 70 is typically of the same stretch-resistant material as the chair seat panel 16, and is attached to each side of the back frame by, e.g., sheet metal screws, pop rivets, or equivalent fasteners. Alternately, the panel may be formed into loops and placed over the sides of the chair back frame during assembly.

The arm rests 66 are pivotally mounted to the rigid side panels near one end of each arm rest and pivotally mounted to the chair back frame 64 near the other end of each arm rest, part way up the frame, as shown. The hinge straps 68 are pivotally mounted to the rigid side panels near one end of each hinge strap and pivotally mounted to the chair back frame near the other end of each hinge strap, near each end of the chair back frame, as shown. The chair back frame and arm rests conveniently comprise a lightweight metal, such as aluminum, in a tubular configuration. The hinge straps also conveniently comprise a lightweight metal such as aluminum.

The attachments of the chair back frame, the arm rests and the hinge straps are derived from the following geometric considerations. First, in the pack (or storage) configuration (FIGS. 1 and 3), it is desirable to have the seat back lying flush with the top surface 20 of the rigid side panels. For convenience, the ends of the chair back frame are configured to be flush with the rear of the rigid side panel (surface 26), as shown. Second, in the chair configuration (FIG. 2), it is desirable to have the chair back form a comfortable angle for sitting. A convenient angle is about 25° back from vertical.

With these considerations and the obvious strength requirements in mind, the following variables must be selected in order to achieve the desired results:

(1) The two components (x,y) of the position of the anchor pivot 71 of the hinge strap 68 measured from the rear of the side panel and from the centerline of the chair back frame when stored in the pack configuration, respectively;

(2) The length ($L_1$) of the hinge strap 68 from pivot 71 to pivot 72;

(3) The length ($L_2$), measured along the chair back frame between pivotal attachments 72 and 76 of the hinge strap and the arm rest, respectively;

(4) The distance (R) from the arm rest pivot 74 on the rigid side panel to the arm rest pivot 76 on the chair back frame. It should be noted that the bend angle of the arm rest at 78 is not critical;

(5) The distance ($\Delta$) from the arm rest pivot 74 to the centerline of the chair back frame in the pack configuration; and (6) The tilt angle ($\alpha$) of the chair back in the erected configuration, measured from vertical.

The relationship between these variables is expressed in the equation:

$$R^2 = \left( \frac{C_1^2 + 2C_1\Delta + C_2^2}{2C_2} \right)^2 + \Delta^2$$

where, $C_1 = L_2 \cos \alpha$ and, $C_2 = 2(L_1^2 - y^2)^{\frac{1}{2}} - L_2(1 + \sin \alpha)$ Converting the backpack chair of the invention from the pack to chair configuration is quite simple. The backpack is placed on the ground or suitable surface, then the chair back frame is simply lifted and rotated away from the backpack frame until further rotation is impossible. When fully erected, the ends of the chair back frame rest on the top surface 20 of the backpack frame, as shown in FIG. 2. Collapsing the chair is simply the reverse of the above procedure.

As an example of a convertible backpack chair of the invention, two rigid side panels are constructed of an injection-molded structural polycarbonate plastic foam. The panels are 25 inches in length, 6½ inches in width and 1 inch in overall thickness, including ribbing. Three 15¾ inch long spacer bars (the two primary spacer bars being 1 inch in diameter, the secondary spacer bar being ¾ inch in diameter) are attached into ⅜ inch recessed openings by means of a ¼ inch threaded rod interior and coaxial therewith and T-nuts. The inside pack frame width is 15 inches. Hollow aluminum tubing, 1 inch in diameter, is used for all chair portions.

One set of variables which satisfy the geometric constraints given above are approximately as follows:

| | |
|---|---|
| x = 5.000 inches | $L_2$ = 5.125 inches |
| y = 3.908 inches | $\alpha$ = Arcsin (0.420) |
| $L_1$ = 5.750 inches | $\Delta$ = 1.375 inches |
| R = 15.500 inches | |

It is clear that additional features, obvious to one skilled in the art, are within the scope of this invention. For example, adjustment of the angle of the chair back frame may be achieved by providing a series of attachment holes or a movable attachment of the hinge anchor pivot 71 to the rigid side panels. A further modification within the scope of this invention comprises a conventional backpack with all the features disclosed herein, except that the chair seat and chair back portion are eliminated, or provided in a detachable configuration. Also, the lumbar strap 60 may be eliminated, so long as other support means are provided to prevent the bottom part of the pack frame and the contents of the pack from interfering with the comfort of the user.

What is claimed is:

1. A convertible backpack chair comprising:

(a) two parallel rigid panels spaced apart, defining side, top, bottom and end surfaces of a generally rectangular storage volume contained therebetween;

(b) a pack bag comprising at least one compartment located within said storage volume and supported between said rigid side panels by support means;

(c) a pair of shoulder straps for supporting the pack on the shoulders of the user, the straps being provided on the bottom surface of said storage volume;

(d) lumbar support means, provided on the same surface as said shoulder straps; and (e) a collapsible chair portion and seat portion provided on the opposite surface, said collapsible chair portion comprising:

(i) a generally U-shaped chair back frame, (ii) a pair of arm rests, one end of each arm rest being pivotally attached to said chair back frame and the other end of each being pivotally attached to said rigid side panels, (iii) a pair of hinge straps, one end of each being pivotally attached near the ends of said chair back frame and the other end of each being pivotally attached to said rigid side panels, and (iv) a back support panel attached to said chair back frame.

2. The convertible backpack chair of claim 1 in which said seat portion is integral to said pack bag.

3. The convertible backpack chair of claim 1 in which said two rigid side panels are maintained apart by spacer bars.

4. The convertible backpack chair of claim 1 in which said rigid side panels comprise a high strength, injection-molded plastic.

5. A convertible backpack chair comprising:

(a) two parallel rigid side panels maintained apart by spacer bars, defining side, top, bottom and end surfaces of a generally rectangular storage volume contained therebetween;

(b) a pack bag comprising two compartments located within said storage volume and supported between said rigid side panels by support means, each compartment provided with a separate opening;

(c) a pair of adjustable shoulder straps for supporting the pack on the shoulders of a user, said straps being provided on the bottom surface of said storage volume;

(d) a resilient, adjustable lumbar strap, provided on the same surface as said shoulder straps;

(e) a collapsible chair portion provided on the opposite surface, said collapsible chair portion comprising:

(i) a generally U-shaped chair back frame, (ii) a pair of arm rests, one end of each arm rest being pivotally attached to said chair back frame and the other end of each being pivotally attached to said rigid side panels.

(iii) a pair of hinge straps, one end of each being pivotally attached near the ends of said chair back frame and the other end of each being pivotally attached to said rigid side panels, and (iv) a back support panel attached to said chair back frame, said back support panel comprising stretch-resistant material; and (f) a seat portion provided on the same surface of said storage volume as said collapsible chair portion, said seat portion being integral to said pack bag and comprising stretch-resistant material.

6. The convertible backpack chair of claim 5 in which said rigid side panels comprise a high strength, injection-molded plastic.

7. The convertible backpack chair of claim 5 in which at least one of said compartments is provided with an insulating liner.

8. A backpack comprising:

(a) two parallel rigid side panels spaced apart, defining side, top, bottom and end surfaces of a generally rectangular storage volume contained therebetween;

(b) a pack bag comprising at least one compartment located within said storage volume and supported between said rigid side panels by support means;

(c) a pair of shoulder straps for supporting the pack on the shoulders of a user, the straps being provided on the bottom surface;

(d) a resilient lumbar strap, provided on the same surface as said shoulder straps;

(e) a detachable, collapsible chair portion provided on the top surface, said collapsible chair portion comprising:

(i) a generally U-shaped chair back frame, (ii) a pair of arm rests, one end of each arm rest being pivotally attached to said chair back frame and the other end of each being pivotally attached to said rigid panels, (iii) a pair of hinge straps, one end of each being pivotally attached near the ends of said chair back frame and the other end of each being pivotally attached to said rigid side panels, and (iv) a back support panel attached to said chair back frame; and (f) a seat portion provided on the same surface of said storage volume as said collapsible chair portion.

9. The backpack of claim 8 in which said two rigid side panels are maintained apart by spacer bars.

10. The backpack of claim 8 in which said rigid side panels comprise a high strength, injection-molded plastic.

* * * * *